US007503539B2

(12) United States Patent
Knight

(10) Patent No.: US 7,503,539 B2
(45) Date of Patent: Mar. 17, 2009

(54) PORTABLE BOOK HOLDER AND METHOD OF USE

(75) Inventor: Jason Knight, 2736 County Road 91, Bellefontaine, OH (US) 43311

(73) Assignee: Jason Knight, Bellefontaine, OH (US)

( * ) Notice: Subject to any disclaimer, the term of this patent is extended or adjusted under 35 U.S.C. 154(b) by 453 days.

(21) Appl. No.: 11/263,640

(22) Filed: Oct. 31, 2005

(65) Prior Publication Data

US 2007/0096002 A1 May 3, 2007

(51) Int. Cl.
*A47B 23/00* (2006.01)

(52) U.S. Cl. ..... 248/448; 248/454; 248/458; 281/45

(58) Field of Classification Search ..... 248/444.1, 248/444, 446, 447, 448, 454, 455, 458; 281/51, 281/28, 42, 45
See application file for complete search history.

(56) References Cited

U.S. PATENT DOCUMENTS 1,184,246 A * 5/1916 Klein ..... 248/448
1,570,973 A * 1/1926 Simonelli ..... 248/449
3,198,475 A * 8/1965 Flahive ..... 248/445
3,951,374 A 4/1976 Quigley
4,145,022 A * 3/1979 Comfort ..... 248/453
4,239,171 A 12/1980 Huls et al.
D278,578 S 4/1985 Jensen
4,620,687 A * 11/1986 Bishop ..... 248/447.2
D327,172 S * 6/1992 Pagano ..... D6/312
5,372,348 A * 12/1994 Cheng ..... 248/447.2
5,649,683 A * 7/1997 Ahn ..... 248/453
7,226,030 B2 * 6/2007 Burnett-Evans et al. ..... 248/447
2003/0183738 A1 * 10/2003 Weingartner ..... 248/453

* cited by examiner

*Primary Examiner*—J. Allen Shriver
*Assistant Examiner*—Steven Marsh
(74) *Attorney, Agent, or Firm*—Galasso & Ass., LP

(57) ABSTRACT

A portable book holder capable of expanding to fit various size books. The base includes an upper section that is capable of being extended in order to accommodate books that are taller. Additionally, there are two book supports that are adjustable outwardly based on the thickness of a particular book. The two book supports are also adjustable with a semi-circular base adjuster thereby allowing for the adjustment based on the width of a book. The portable book holder easily folds out to form the book support and easily folds up for portability.

8 Claims, 2 Drawing Sheets

DETAIL A

PORTABLE BOOK HOLDER AND METHOD OF USE

FIELD OF THE DISCLOSURE

A portable book holder capable of being adjusted to hold various size books open.

BACKGROUND

At some point in time we have all read books and wished that we had a means of holding the book open. Particularly when in college, holding a book open for studying or reading can become cumbersome when you are also trying to take notes or complete various papers. Another example of when it would be nice to have an adjustable book holder is when you are cooking. Cook books come in all different sizes from small thin paperbacks to heavy thick hard back books. It is very irritating when you are cooking to have to keep finding your page because the book will not stay open. It is also very annoying trying to get a small book to sit and stay open on most of the book holders that are currently available.

While there are a number of book holders on the market, they are not always the best choice. For example, most book holders are not portable and tend to be made of a hard material that makes them awkward to carry from place to place. Also, most book holders are designed to fit a fairly standard size book. Unfortunately, books come in a wide variety of not only sizes but thicknesses, as well as they come in hard back and paper back form. All of these variants make finding a book holder to accommodate all of these needs very difficult.

One example of a book holder that is described in Design Patent No. Des. 278,578 by Jensen. In this configuration, the book simply sits on the holder. This book holder also allows the angle of the book to be adjusted. However, there is no means of holding the book open to a particular page. Also, the size of the book could potentially be a relevant factor since there is no way of adjusting for size, but is purely based on the size of the holder itself.

Another example of a book holder is described in U.S. Pat. No. 4,239,171 by Huls et al. This book holder is made of light materials and provides some flexible options for using the book holder. For example, it comprises a center leg that can be used to stick in the ground or sand (if you are at the beach) or it has additional legs that can be attached for reading on a solid surface. However, it order to hold a book, the book must be placed between a piece of plexiglass and a spring system allowing the book to be held rigidly in place against the plexiglass for easy reading. Unfortunately, in order to turn the page, the book would have to be removed from the holder, the page turned and the book replaced in the holder. With this particular type of book holder you also have the risk of the spring system getting stretched and no longer supporting the book.

U.S. Pat. No. 3,951,372 by Quigley is another example of a book holder. In this particular patent, the holder is comprised of a foamable plastic material which has been molded. It further comprises a series of elastomeric strips of inverted V-form. These elastomeric strips are used to hold the book in place and to keep the book open to the desired page. The particular book holder is also designed to be placed on either side for purposes of reading in bed, or it can be placed on the stomach or thigh or any other portion of the body depending on whether the reader is sitting, reclining or lying down.

While there are obviously a number of book holder options available including the standard holder that sits on a cabinet, none of these book holders address the need for a portable type holder that can easily be folded up and taken with one to another place. There are lots to places where people read books and/or study. For example, depending on your geographical location, you might like to read on the beach. College students seem to find lots of interesting places to study from the library to the student union. As books get heavier, the need for a book holder that accepts these books increases. However, the weight of the book holder, the ease of use and the portability of the holder must remain simple and light.

SUMMARY OF THE DISCLOSURE

In one embodiment the portable book holder comprises a base.

In another embodiment the portable book holder comprises a tilt adjustment attached to the base.

In still another embodiment the portable book holder comprises an upper section.

In yet another embodiment of the portable book holder the upper section is attached to the tilt adjustment.

In another embodiment the upper section of the portable book holder comprises a first upper piece and a second upper piece.

In still another embodiment the first and second upper pieces of the upper section of the portable book holder are attached by a hinge mechanism.

In yet another embodiment the portable book holder comprises a first and second extendable spine support.

In another embodiment the first and second extendable spine support are attached to the first upper piece and the second upper piece, respectively.

In still another embodiment the portable book support comprises a first book support and a second book support.

In yet another embodiment the first and second book supports extend outwardly from the base.

In another embodiment the first and second book supports each comprise a slideable extension.

In still another embodiment the portable book support comprises a balance support.

In another embodiment the balance support is attached to the upper section.

In yet another embodiment the first upper piece and the second upper piece each comprise a height adjustment mechanism.

In another embodiment the first book support and the second book support each comprise a length adjustment mechanism.

In still another embodiment the base comprises a semi-circular shaped base adjuster.

In yet another embodiment the first and second book supports are operable to rotate within the semi-circular base adjuster.

In another embodiment the first book support and the second book support each comprise an upward extending support on the outwardly end of the first book support and the second book support.

In still another embodiment the tilt adjustment is operable to allow the upper section to rotate forward and backward to adjust the angle of the upper section.

Still other advantages of various embodiments will become apparent to those skilled in this art from the following description wherein there is shown and described preferred embodiments of this invention simply for the purposes of illustration. As will be realized, the invention is capable of other different aspects and embodiments without departing from the scope of the invention. Accordingly, the advantages, drawings, and descriptions are illustrative in nature and not restrictive in nature.

DETAILED DESCRIPTION OF THE DRAWING FIGURES

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
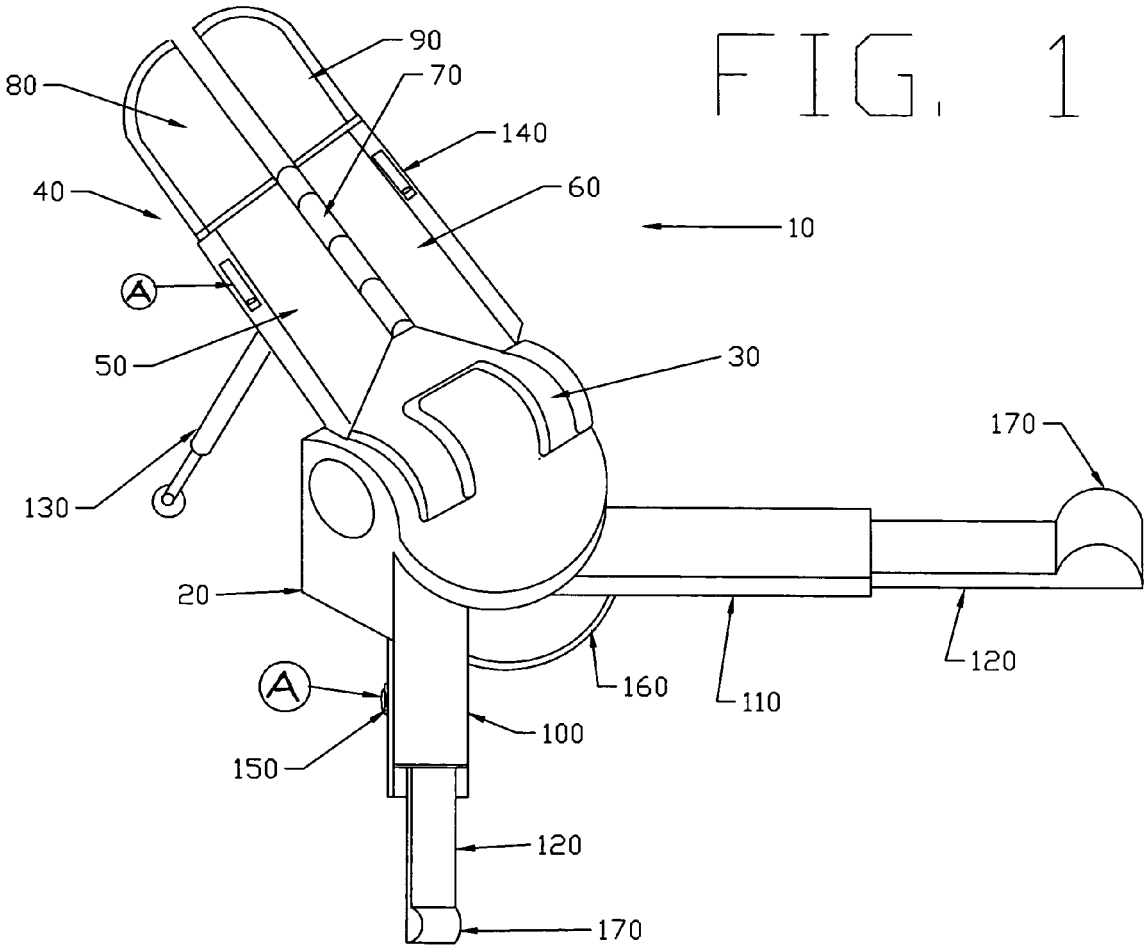
FIG. 1 is perspective view of a portable book holder

FIG. 1 is a perspective view of a portable book holder 10 comprising a base 20, a tilt adjustment 30, an upper section 40, a first upper piece 50, a second upper piece 60, a hinge mechanism 70, a first extendable spine support 80, a second extendable spine support 90, a first book support 100, a second book support 110, a slideable extension 120, a balance support bracket 130, a height adjustment mechanism 140, a length adjustment mechanism 150, a semi-circular shaped base 160, upward extending supports 170 and an adjustment clip 180.

FIG. 1 depicts a portable book holder 10 in an expanded or open position. The base 20 comprises a tilt mechanism 30 that allows the upper section 40 to rotate with the base 20 thereby adjusting the angle of the back of a book when it is placed on the portable book holder 10. The upper section 40 comprises a first upper piece 50 and a second upper piece 60 that operate to support the spine of the book. The first upper piece 50 and the second upper piece 60 are attached by a hinge mechanism 70 which allows the book to be opened to varying degrees based on the size of the book and the desire of the reader. The upper section 40 also includes a first extendable spine support 80 and a second extendable spine support 90 which are capable of being adjusted to accommodate the height of the book. By having the first extendable spine support 80 and the second extendable spine support 90, if a reader has a very tall book these supports can be adjusted upward to provide support and prevent the book from toppling over backwards. Alternatively, should the reader have a rather short book and/or limited space then the first extendable spine support 80 and the second extendable spine support 90 can be adjusted downward into the first upper section 50 and the second upper section 60, respectively, to facilitate a shorter book or space restriction. Additionally, the upper section 40 has attached a balance support bracket 130, which provides support for the upper section 40. The balance support bracket 130, is designed to keep the upper section 130 balanced when a larger book is placed on the portable book holder 10. By providing support on the back of the upper section 40, the portable book holder 10 is prevented from turning over backwards.

FIG. 1 also illustrates a semi-circular shaped base 160 which has a first book support 100 and a second book support 110 extending outward. The semi-circular shaped base 160 allows the user to rotate the first book support 100 and the second book support 110 to various widths. By doing this the first book support 100 and the second book support 110 can conform to different size books. For example, most children's books are small and not very thick. By being able to adjust the first book support 100 and the second book support 110, the portable book holder 10 can facilitate these particular books. Alternatively, most novels tend to bigger, thicker books. Again, by adjusting the first book support 100, the second book support 110 and the first upper piece 50, the second upper piece 60, the first extendable spine support 80 and the second extendable spine support 90 these types of books can comfortably fit onto the portable book holder 10. The first book support 100 and the second book support 110 each have an upward extending support 170 located on the end that extends outward from the semi-circular shaped base. This upward extending support 170 functions to hold a book on the portable book holder 10, by preventing the book from sliding off.

Figure 2:
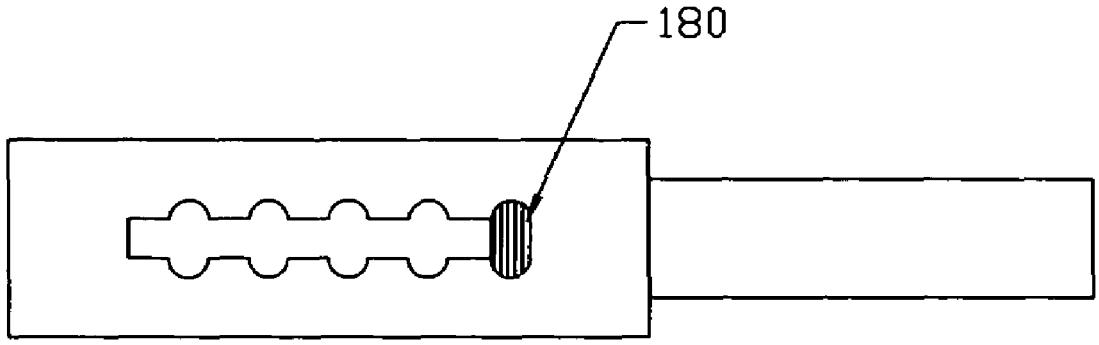
FIG. 2 is a detailed view of the length/height adjustment mechanism depicted in FIG. 1

FIG. 2 is a detailed view of the height adjustment mechanism 140 which is identical to the length adjustment mechanism 150. The height adjustment mechanism 140 is located on the first upper piece 50 and the second upper piece 60. The length adjustment mechanism 150 is located on the first book support 100 and the second book support 110. The height adjustment mechanism 140 allows the user to push the adjustment clip 180 causing either the first extendable spine support 80 or the second extendable spine support 90 to move up or down. Alternatively, the length adjustment mechanism 150 allows the user to push the adjustment clip 180 to adjust the slideable extension 120 of the first book support 100 or the second book support 110 causing the slideable extension 120 to extends outward from the first book support 100 and/or the second book support 110. By adjusting the height of the first upper piece 50 and the second upper piece 60 by extending the first extendable spine support 80 and the second extendable spine support 90 and the length of the first book support 100 and the second book support 110 by way of the slideable extension 120, a user can easily adjust the portable book holder 10 to fit any size book.

When one is done using the portable book holder 10, it easily folds down for storage or transportation. For example, if one wanted to take the portable book holder 10 with them to the library, it folds up and can be placed is a back pack or other similar carrying device. By using the height adjustment mechanism 140, the first extendable spine support 80 and the second extendable spine support 90 can be adjusted down into the first upper piece 50 and the second upper piece 60, respectively. The slideable extension 120 of the first book support 100 and the second book support 110 can be adjusted inward. Then the upper section 40 can be folded downward toward the base 20 by way of the tilt adjustment 30 of the portable book holder 10. The balance support bracket 130 will then fold inward toward the upper section 40 and lay against the upper section 40. The portable book holder 10 is then it its closed position and ready to be transported or stored Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

What is claimed:

1. A portable book holder comprising: a base comprising a tilt adjustment an upper section attached to said tilt adjustment, said upper section comprising a first upper piece and a second upper piece; wherein said first and second upper pieces are attached by a hinge mechanism; a first extendable spine support and a second extendable spine support attached to said first upper piece and said second upper piece; a first book support and a second book support extending outwardly from said base; wherein said first book support and said second book support each comprise a slideable extension; and a balance support bracket attached to said upper section; wherein said base further comprises a semi-circular shaped base adjuster; wherein said first and second book supports are operable to rotate within said semi-circular base adjuster.

2. A portable book holder of claim 1, wherein said first upper piece and second upper piece each comprise a height adjustment mechanism.

3. A portable book holder of claim 1, wherein said first book support and said second book support each comprise a length adjustment mechanism.

4. A portable book holder of claim 1, wherein said first and second book supports further comprise an upward extending support on the outwardly end of said first and second book supports.

5. A portable book holder of claim 1, wherein said tilt adjustment is operable to allow said upper section to rotate forward and backward thereby adjusting the angle of said upper section.

6. A portable book system comprising: a base having a tilt adjustment located on the upper side and a semi-circular shaped base adjuster; an upper section comprised of a first upper section and a second upper section, whereby said first and second upper section includes first extendable spine support and a second extendable spine support each having an extendable height adjusting mechanism: and wherein said first and second upper sections are attached by a hinge mechanism; a first book support and a second book support extending outwardly from said semi-circular shaped base adjuster; wherein said first book support and said second book support each comprise a slideable extension; a length adjustment mechanism located on said first and second book supports; and an upwardly extending support on the outwardly extending end of said first book support and said second book support; a balance support bracket attached to said upper section; wherein said first book support and said second book support are operable to rotate within said semi-circular shaped base adjuster.

7. A portable book system of claim 6, wherein said tilt adjustment rotates said upper section forward and backwards to adjust the angle.

8. A method for supporting a book comprising a base having a tilt adjustment and a semi-circular shaped base adjuster, an upper section comprised of a first upper piece and a second upper piece attached by a hinge mechanism and a first extendable spine support and a second extendable spine support, and a first book support and a second book support outwardly extending from said base wherein said first and second book support each comprise a slideable extension and a balance support; comprising the steps of: setting up the book support by extending said upper section; opening up said first upper piece and said upper second piece; extending said first book support and said second book support; placing a book on the book support; adjusting the first book support and second book support length; adjusting the first book support and second book support angle within said semi-circular shaped base adjuster based on the size of a book; adjusting the angle of the upper section using said tilt adjustment; extending said first spine support and said second spine support; removing said book; retracting said slideable extension into said first book support and said second book support; retracting said first extendable spine support and said second extendable spine support; closing said first upper piece and said second upper piece; folding said upper section down toward said base.

* * * * *